United States Patent [19]

Ahrens

[11] Patent Number: 4,932,648

[45] Date of Patent: Jun. 12, 1990

[54] PLAYGROUND SLIDE

[75] Inventor: Paul W. Ahrens, Monett, Mo.

[73] Assignee: Miracle Recreation Equipment Company, Monett, Mo.

[21] Appl. No.: 312,185

[22] Filed: Feb. 21, 1989

[51] Int. Cl.[5] ..... A63G 21/00

[52] U.S. Cl. ..... 272/56.5 R; 182/49; 104/70

[58] Field of Search ..... 272/56.5 R, 56.5 SS; 104/69, 70; 182/48, 49; 193/12; 446/125, 127

[56] References Cited

U.S. PATENT DOCUMENTS

| | | | |
|---|---|---|---|
| 1,544,555 | 7/1925 | Chase | 104/69 X |
| 1,648,196 | 11/1927 | Rohmer | 104/70 |
| 3,302,949 | 2/1967 | Wolfe | 446/127 X |
| 3,556,522 | 1/1971 | Gale | 272/56.5 R |
| 4,270,748 | 6/1981 | Ray | 272/56.5 R |
| 4,811,943 | 3/1989 | Ahrens | 272/56.5 R |

*Primary Examiner*—Richard E. Chilcot, Jr.
*Attorney, Agent, or Firm*—Zarley, McKee, Thomte, Voorhees & Sease

[57] ABSTRACT

Each of the slide sections making up the bedway are roto molded and have a common shape such that they may be interchanged and reversed end for end. Each connection includes a tongue and groove in the bototm wall and a sidewall extension on one sidewall received in a recessed notch on the other sidewall thereby limiting both vertical and lateral horizontal movement between the slide sections.

7 Claims, 2 Drawing Sheets

PLAYGROUND SLIDE

BACKGROUND OF THE INVENTION

This invention relates to a playground slide having a slide bedway made up of a plurality of interconnected slide sections. The object of such a slide is to provide a solid connection between slide sections but which is easy to assemble and disassemble. The slide section should be inexpensive to manufacture, durable in use and provide a smooth bedway surface on which children may slide. Fasteners should be hidden to prevent injury to hands of the children using the slide.

SUMMARY OF THE INVENTION

The slide of this invention has identical slide sections which are roto molded with a hollow interior. The slide sections may be reversed end to end and placed anywhere along the length of the slide. A solid positive lock between adjacent ends of slide sections is provided. The bottom wall at each end includes a tongue and groove locked together by a bolt. One sidewall has a sidewall extension which is received in a notched recess in the other sidewall. The tongue and groove limits relative vertical movement while the sidewall extension in the notched recess limits lateral or horizontal movement. The inner ends of the bolts are disposed in the interior of the side sections out of the reach of childern's hands.

DESCRIPTION OF THE PREFERRED EMBODIMENT

Figure 2:
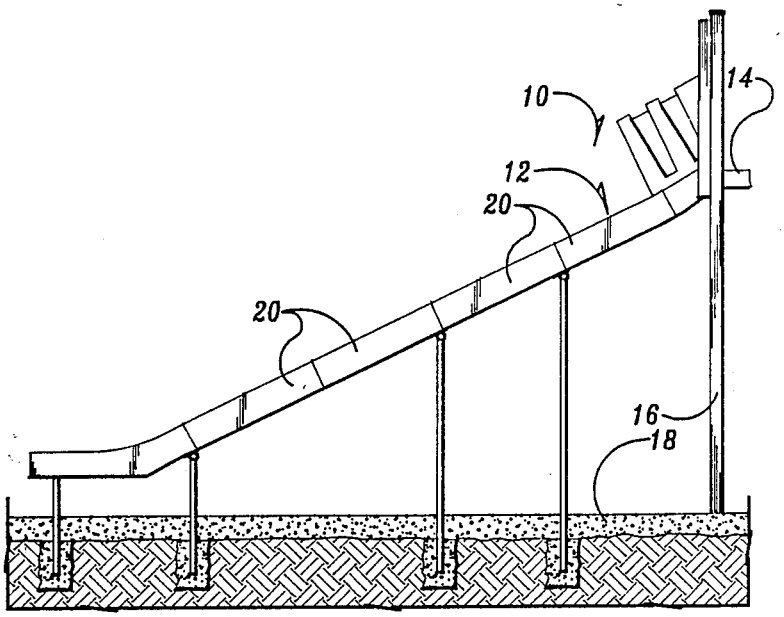
FIG. 2 is a view similar to FIG. 1 but showing a straight slide bed.
Figure 1:
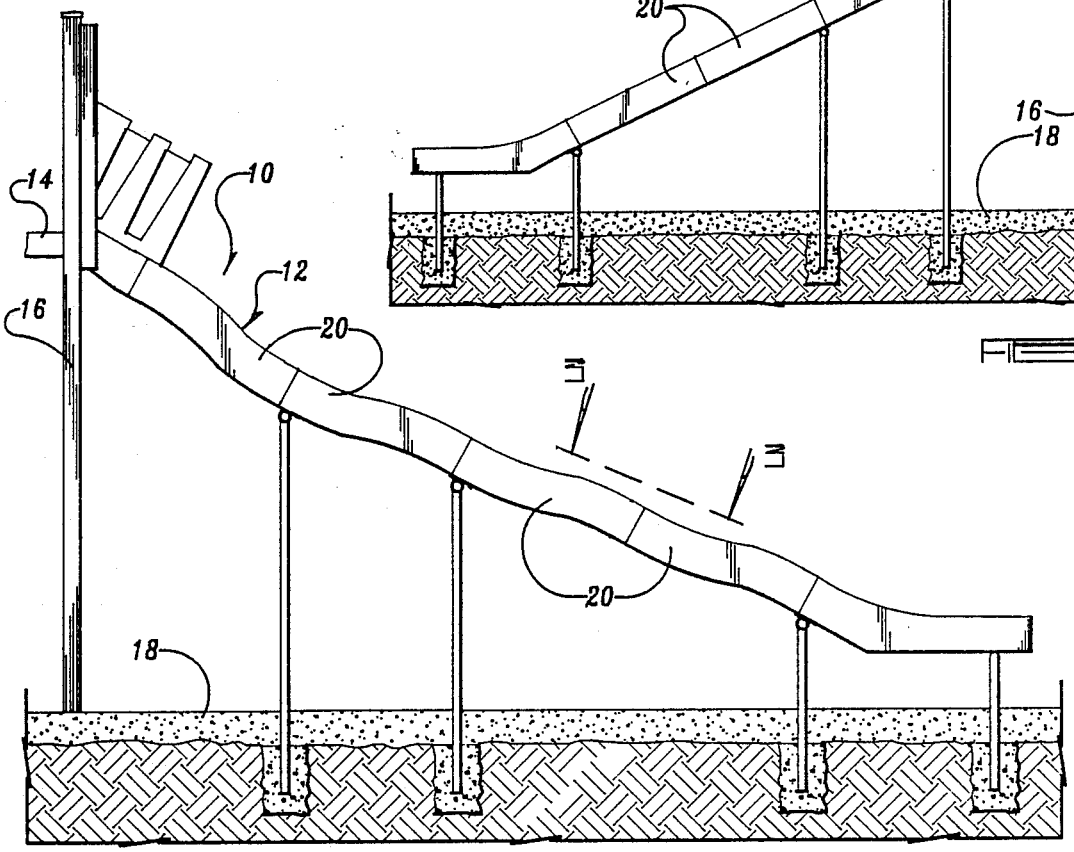
FIG. 1 is a fragmentary side elevational view of a playground wave slide.
Figure 3:
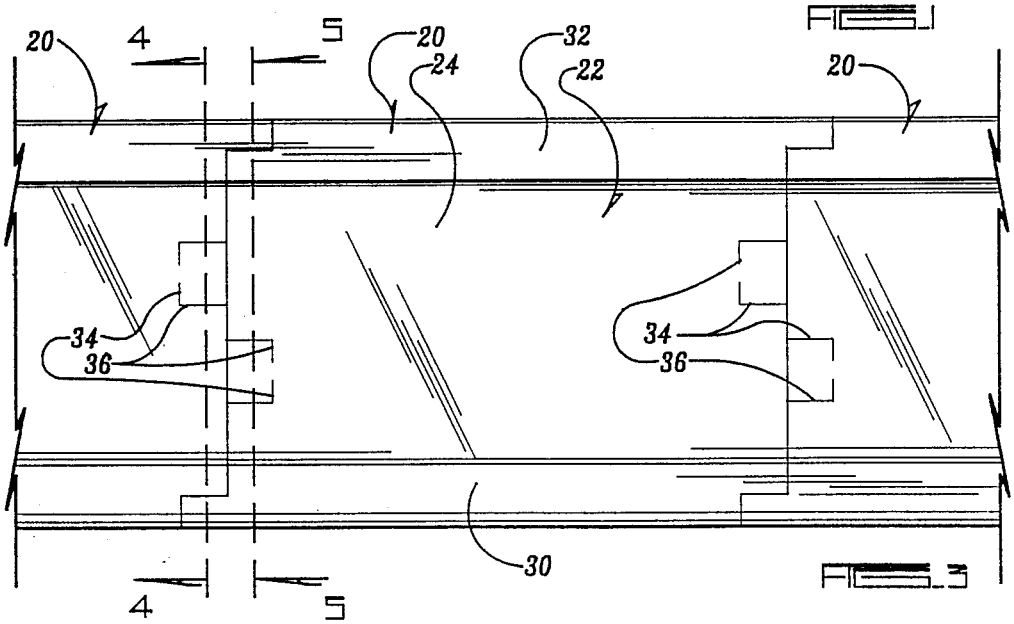
FIG. 3 is a cross-sectional view taken along line 3—3 in FIG. 1.
Figure 4:
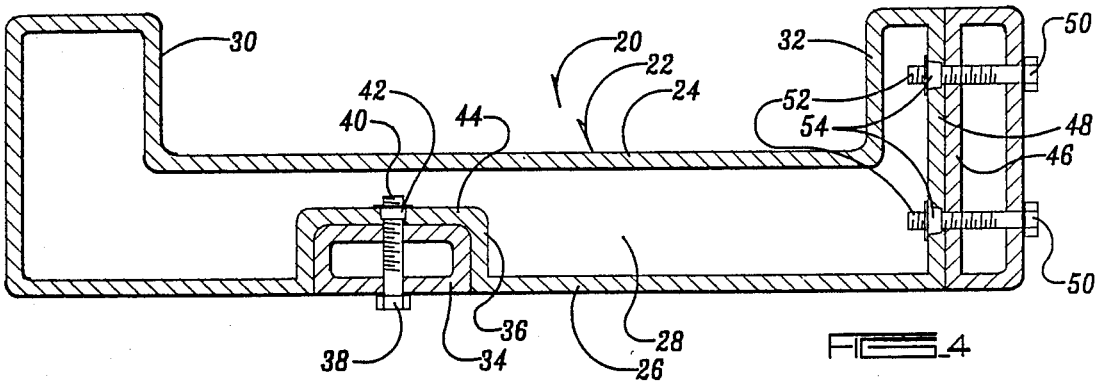
FIG. 4 is a cross-sectional view taken along line 4—4 in FIG. 3.
Figure 6:
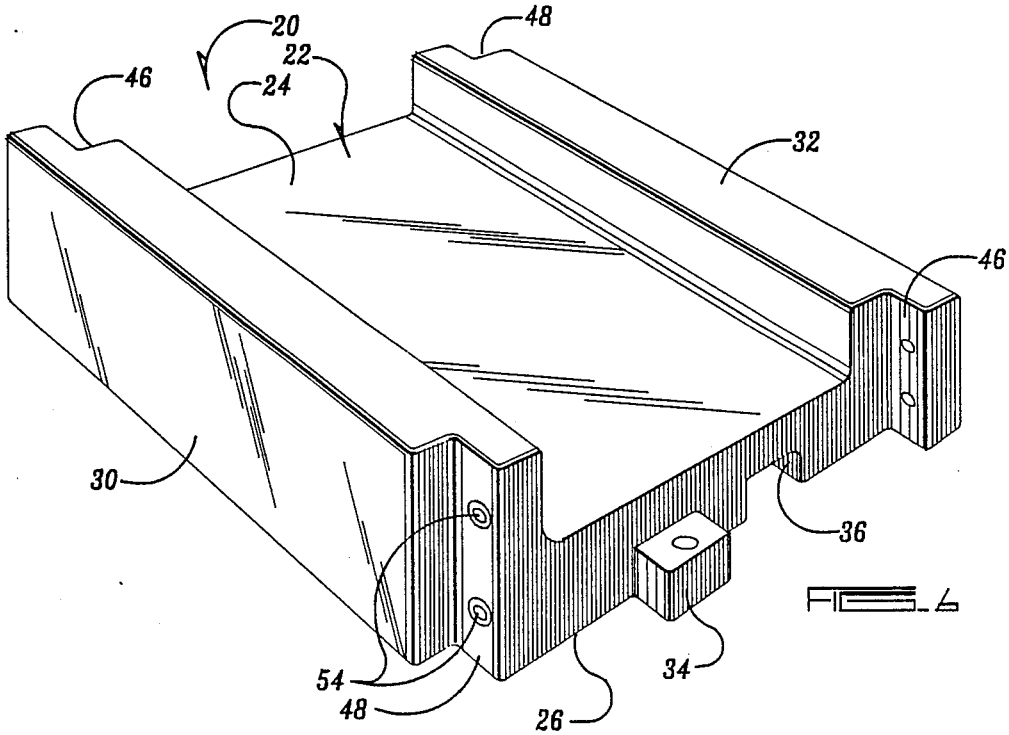
FIG. 6 is a perspective view of a slide section.

The slide of this invention is referred to generally in FIG. 1 by the reference numeral 10 and includes a bedway 12 extending from an elevated platform 14 or ladder 16 to the ground 18. The bedway 12 is made up of a plurality of slide sections 20 shown in detail in FIG. 6.

Each slide section 20 includes a bottom wall 22 having a top slide surface 24 and a bottom surface 26. The slide section 20 is roto molded and has a hollow interior 28 with opposite sidewalls 30 and 32.

Figure 5:
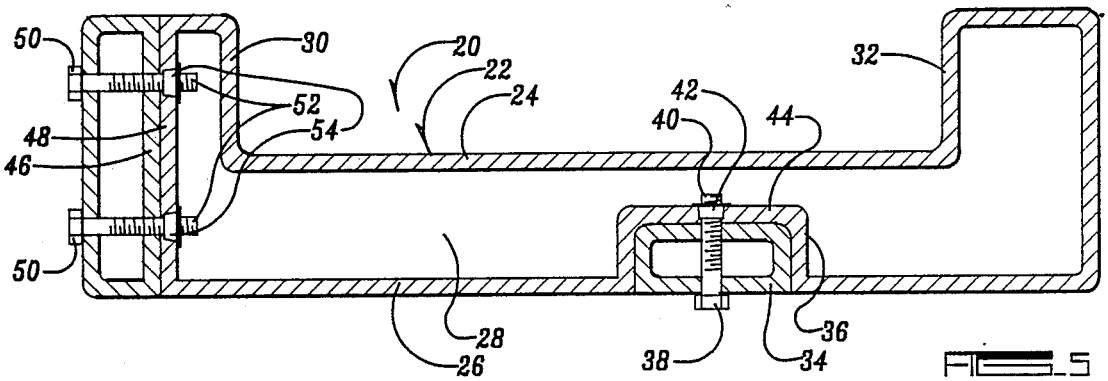
FIG. 5 is a cross-sectional view taken along line 5—5 in FIG. 3.

The bottom wall 22 includes at each end a longitudinally outwardly extending tongue 34 received in a complimentarily-shaped groove 36 in the bottom side 26 of the bottom wall 22. The tongue 34 in the groove 36 limits relative vertical movement between the slide sections which are locked together by bolt 38 having its inner end 40 connected to a T-nut 42 molded into the groove wall 44 as seen in FIG. 5.

The sidewall 32 has a wall extension 46 which is received in a notched recess 48 on the opposite wall 30. The wall extension 46 is locked in the notched recess 48 by bolts 50 having ends 52 received in T-nuts 54 on the interior 28 of the slide section 20. The sidewall extension 46 in the recessed notch 48 limits relative horizontal or lateral movement between the side sections 20.

It is thus seen that slide sections 20 may be interchanged or reversed end for end as they are identical in shape. The top surface 24 of each slide section connects with the top surface of the adjacent sections to provide a continuous smooth bedway surface.

I claim:

1. A playground slide comprising, a plurality of interchangeable reversible interconnected one-piece slide sections, a ladder having upper and lower ends, said slide sections extending from said upper end of said ladder to the ground, each of said slide sections being hollow and having a bed with oppositely disposed side rails; said bed having opposite end walls, and top and bottom walls which merge into said hollow side rails to form for each side rail spaced apart inside and outside walls interconnected by a rail top wall, each of said bed end walls having an outwardly extending hollow tongue portion having top and bottom walls opposite side walls and an outer end wall; and said bed bottom wall and each of said end walls having a groove shaped to matingly receive said tongue on the adjacent slide section, said groove including a top wall and opposite side walls interconnected by an inner end wall, and a two part fastener locking said groove, one of said fastener parts extending through said top and bottom walls of said tongue and being locked to the second part in the top wall of said groove.

2. The structure of claim 1 wherein said groove extends from said bottom wall of said bed towards the top wall of said bed with the top wall of said groove being positioned approximately halfway between said bed top and bottom walls.

3. The structure of claim 2 wherein said tongue and groove are located approximately midway between said oppositely disposed side rails.

4. A playground slide comprising, a plurality of interchangeable reversible interconnected one-piece slide sections, a ladder having upper and lower ends, said slide sections extending from said upper end of said ladder to the ground, each of said slide sections being hollow and having a bed with oppositely disposed side rails; said bed having opposite end walls, and top and bottom walls which merge into said hollow said rails to form for each side rail spaced apart inside and outside walls interconnected by a rail top wall, each of said side rails having a longitudinally extending rail extension at one end and a notched recess at the opposite end of a shape corresponding to the shape of the rail extension such that said rail extension on one slide section is received in the notched recess on a contiguous slide section, said notched recess having an outer wall which is an offset continuation of the outer side wall of the side rail, said rail extension having inner and outer spaced apart walls interconnected by an end wall, and a two part fastener means interconnecting said rail extension to said notched recess, one of said fastener parts extending through said inner and outer walls of said rail extension and being in locking engagement with the second part of said fastener in the outer wall of said notched recess.

5. The structure of claim 4 wherein said rail extension extends from said bed bottom wall to the rail top wall.

6. The structure of claim 5 wherein the distance between the inner and outer spaced walls of said rail extension is approximately half the distance between the inside and outside walls of said rail.

7. A playground slide comprising, a plurality of interchangeable reversible interconnected one-piece slide sections, a ladder having upper and lower ends, said slide sections extending from said upper end of said ladder to the ground, each of said slide sections being hollow and having a bed with oppositely disposed side rails; said bed having opposite end walls, and top and bottom walls which merge into said hollow side rails to form for each side spaced apart inside and outside walls interconnected by a rail top wall, each of said bed end walls having an outwardly extending hollow tongue portion having top and bottom walls opposite side walls and an outer end wall; and said bed bottom wall and each of said end walls having a groove shaped to matingly receive said tongue on the adjacent slide section, said groove including a top wall and opposite side walls interconnected by an inner end wall, a two part fastener locking said tongue to said groove, one of said fastener parts extending through said top and bottom walls of said tongue and being locked to the second part in the top wall of said groove, each of said side rails having a longitudinally extending rail extension at one end and a notched recess at the opposite end of a shape corresponding to the shape of the rail extension such that said rail extension on one slide section is received in the notched recess on a contiguous slide section, said notched recess having an outer wall which is an offset continuation of the outer side wall of the rail, said rail extension having inner and outer spaced apart walls interconnected by an end wall, and a two part fastener means interconnecting said rail extension to said notched recess, one of said fastener parts extending through said inner and outer walls of said rail extension and being in locking engagement with the second part of said fastener in the outer wall of said notched recess.

* * * * *